US008855541B2

(12) United States Patent
Naito et al.

(10) Patent No.: US 8,855,541 B2
(45) Date of Patent: Oct. 7, 2014

(54) HEATING DEVICE AND IMAGE FORMING APPARATUS

(75) Inventors: Yasutaka Naito, Kanagawa (JP); Shigehiko Haseba, Kanagawa (JP); Kazuyoshi Itoh, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 134 days.

(21) Appl. No.: 13/566,706

(22) Filed: Aug. 3, 2012

(65) Prior Publication Data

US 2013/0259546 A1 Oct. 3, 2013

(30) Foreign Application Priority Data

Mar. 27, 2012 (JP) ..... 2012-071125

(51) Int. Cl.
*G03G 15/20* (2006.01)

(52) U.S. Cl.
USPC ..... 399/329; 399/334

(58) Field of Classification Search
CPC ..... G03G 15/20; G03G 15/2014; G03G 15/2017; G03G 15/2042; G03G 15/2053; G03G 15/2082; G03G 2215/2003; G03G 2215/20
USPC ..... 399/328, 329, 334
See application file for complete search history.

(56) References Cited

U.S. PATENT DOCUMENTS

| | | | | |
|---|---|---|---|---|
| 6,298,215 | B1 | 10/2001 | Nomura et al. | |
| 7,778,565 | B2 * | 8/2010 | Baba et al. | 399/69 |
| 7,974,563 | B2 * | 7/2011 | Sakai et al. | 399/333 |
| 8,019,266 | B2 * | 9/2011 | Baba et al. | 399/333 |
| 8,145,113 | B2 * | 3/2012 | Murakami et al. | 399/329 |
| 8,498,562 | B2 * | 7/2013 | Yonekawa | 399/329 |
| 8,521,074 | B2 * | 8/2013 | Murakami et al. | 399/329 |
| 8,626,046 | B2 * | 1/2014 | Sekihara et al. | 399/328 |
| 2010/0247185 | A1 * | 9/2010 | Baba et al. | 399/329 |

FOREIGN PATENT DOCUMENTS

| | | | |
|---|---|---|---|
| JP | 04-042184 | A | 2/1992 |
| JP | 2001-066933 | A | 3/2001 |
| JP | 2001-117402 | A | 4/2001 |

* cited by examiner

*Primary Examiner* — David Gray
*Assistant Examiner* — Carla Therrien
(74) *Attorney, Agent, or Firm* — Sughrue Mion, PLLC

(57) ABSTRACT

A heating device includes a magnetic-field generating unit that generates an alternating-current magnetic field, an endless belt, and a heat transfer unit that includes a heat storage layer, a thermosensitive layer, and a diffusion layer. The thermosensitive layer extends so as to separate the magnetic-field generating unit and the heat storage layer from each other, and forms a magnetic path that allows a magnetic flux of the alternating-current magnetic field to pass therethrough in a direction in which the thermosensitive layer extends at a temperature below a Curie temperature and a magnetic path that allows the magnetic flux to extend therethrough and reach the heat storage layer at a temperature higher than or equal to the Curie temperature. The diffusion layer has a higher thermal conductivity than thermal conductivities of the thermosensitive layer and the heat storage layer, and diffusing heat of the belt.

6 Claims, 7 Drawing Sheets

HEATING DEVICE AND IMAGE FORMING APPARATUS

CROSS-REFERENCE TO RELATED APPLICATIONS

This application is based on and claims priority under 35 USC 119 from Japanese Patent Application No. 2012-071125 filed Mar. 27, 2012.

BACKGROUND

The present invention relates to a heating device and an image forming apparatus.

SUMMARY

According to an aspect of the invention, there is provided a heating device including a magnetic-field generating unit, an endless belt, and a heat transfer unit. The magnetic-field generating unit generates an alternating-current magnetic field. The endless belt includes a first region in which heat is generated by electromagnetic induction caused by an effect of the alternating-current magnetic field. The endless belt heats and transports a medium that contacts an outer peripheral surface of the endless belt. The heat transfer unit transmits heat to the belt by contacting and sliding along an inner peripheral surface of the belt. The heat transfer unit includes a heat storage layer that stores heat, a thermosensitive layer, and a diffusion layer. The thermosensitive layer is positioned closer to the belt than the heat storage layer is and extends so as to separate the magnetic-field generating unit and the heat storage layer from each other. The thermosensitive layer forms a magnetic path that allows a magnetic flux of the alternating-current magnetic field to pass through the thermosensitive layer in a direction in which the thermosensitive layer extends at a temperature below a Curie temperature, and forms a magnetic path that allows the magnetic flux of the alternating-current magnetic field to extend through the thermosensitive layer and reach the heat storage layer at a temperature higher than or equal to the Curie temperature. The diffusion layer that has a higher thermal conductivity than thermal conductivities of the thermosensitive layer and the heat storage layer, the diffusion layer diffusing heat of the belt along an axial direction of the belt.

BRIEF DESCRIPTION OF THE DRAWINGS

Exemplary embodiments of the present invention will be described in detail based on the following figures, wherein.

DETAILED DESCRIPTION

1. First Exemplary Embodiment 1-1. Structure

Figure 1:
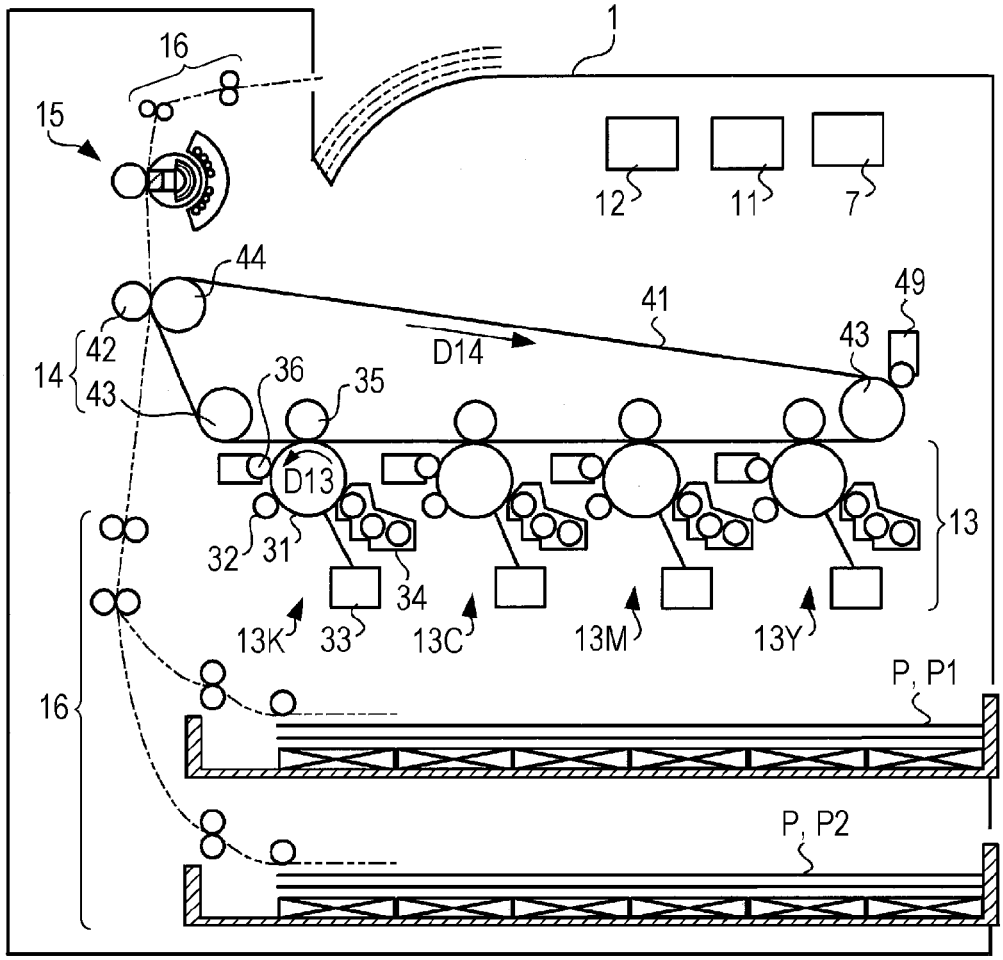
FIG. 1 illustrates the overall structure of an image forming apparatus according to a first exemplary embodiment of the present invention.

FIG. 1 illustrates the overall structure of an image forming apparatus 1 according to a first exemplary embodiment of the present invention. As illustrated in FIG. 1, the image forming apparatus 1 includes a controller 11, a storage unit 12, developing units 13Y, 13M, 13C, and 13K, a transfer unit 14, a heating unit 15, a transport unit 16, and an operating unit 17. The letters Y, M, C, and K appended to the reference numeral 13 represent toners of yellow, magenta, cyan, and black, respectively. The developing units 13Y, 13M, 13C, and 13K basically have a similar structure except for the color of the toner used therein. When it is not necessary to distinguish the developing units 13Y, 13M, 13C, and 13K from each other, the developing units will be referred to simply as "developing units 13" without the letters representing the colors of toner appended at the end.

The controller 11 includes a central processing unit (CPU), a read only memory (RPM), and a random access memory (RAM). The CPU reads computer programs (hereinafter referred to simply as programs) stored in the ROM or the storage unit 12 and executes the programs to control each part of the image forming apparatus 1.

The operating unit 17 includes operation buttons through which various instructions may be input. The operating unit 17 is operated by a user and supplies signals corresponding to the operation performed by the user to the controller 11. The storage unit 12 is a bulk storage, such as a hard disk drive, and stores the programs to be read by the CPU in the controller 11.

The transport unit 16 includes containers and transport rollers. The containers contain sheets of paper P that are cut into predetermined sizes in advance and that serve as media. At least two sizes having different dimensions in a direction perpendicular to a transporting direction, that is, in the width direction, are set as the sizes of the sheets of paper P. Here, two types of sheets of paper P are used, which are sheets of maximum-width paper P1 and sheets of small-width paper P2 that have a smaller width than that of the sheets of maximum-width paper P1. Of the sheets of paper P that may be used in the image forming apparatus 1, the sheets of maximum-width paper P1 are sheets having a maximum width. The controller 11 distinguishes between the two types of sheets of paper P on the basis of the containers in which the sheets are contained. The sheets of paper P that are contained in the contains are fed one at a time by the transport rollers and transported to the transfer unit 14 along a sheet transport path in accordance with an instruction of the controller 11. The media are not limited to sheets of paper, and may instead be, for example, resin sheets. The media are not particularly limited as long as images may be recorded on surfaces thereof.

Each developing unit 13 includes a photoconductor drum 31, a charging device 32, an exposure device 33, a developing device 34, a first transfer roller 35, and a drum cleaner 36. The photoconductor drum 31 is an image carrier that includes a charge generating layer and a charge transport layer, and is rotated in the direction of arrow D13 in FIG. 1 by a driving unit (not shown). The charging device 32 charges the surface of the photoconductor drum 31. The exposure device 33 includes a laser source and a polygonal mirror (neither is shown). The exposure device 33 is controlled by the controller 11 so as to emit a laser beam corresponding to image data toward the photoconductor drum 31 that has been charged by the charging device 32. Thus, an electrostatic latent image is formed on the photoconductor drum 31. The controller 11 may receive the above-described image data from an external device through a communication unit (not shown). The external device may be, for example, a reading device capable of reading an original image or a storage device that stores data of an image.

The developing device 34 contains two-component developer including toner of Y, M, C, or K, and magnetic carrier, such as ferrite powder. The developing device 34 includes a magnetic brush, and a tip of the magnetic brush contacts the surface of the photoconductor drum 31. Accordingly, the toner adheres to portions of the surface of the photoconductor drum 31 that are exposed to light by the exposure device 33, that is, to scanning line portions of the electrostatic latent image. As a result, an image is formed (developed) on the photoconductor drum 31.

The first transfer roller 35 generates a predetermined potential difference between the photoconductor drum 31 and an intermediate transfer belt 41 included in the transfer unit 14 at a position where the photoconductor drum 31 faces the intermediate transfer belt 41. Owing to the potential difference, the image is transferred onto the intermediate transfer belt 41. The drum cleaner 36 removes the toner that remains on the surface of the photoconductor drum 31 instead of being transferred after the transferring of the image, and removes the electricity from the surface of the photoconductor drum 31. In other words, the drum cleaner 36 removes unnecessary toner and electric charges from the photoconductor drum 31 for the next image forming operation.

The transfer unit 14 includes the intermediate transfer belt 41, a second transfer roller 42, belt transfer rollers 43, and a back-up roller 44. The transfer unit 14 transfers the images formed by the developing units 13 onto a sheet of paper P of the type determined in accordance with the operation performed by the user. The intermediate transfer belt 41 is an endless belt member and is wrapped around the belt transfer rollers 43 and the back-up roller 44. At least one of the belt transfer rollers 43 and the back-up roller 44 is provided with a drive unit (not shown) that rotates the intermediate transfer belt 41 in the direction of arrow D14 in FIG. 1. One or more of the belt transfer rollers 43 and the back-up roller 44 that have no drive unit are rotated by the rotation of the intermediate transfer belt 41. When the intermediate transfer belt 41 is rotated in the direction of arrow D14 in FIG. 1, the images on the intermediate transfer belt 41 is moved to the region between the second transfer roller 42 and the back-up roller 44.

Owing to a potential difference between the second transfer roller 42 and the intermediate transfer belt 41, the images on the intermediate transfer belt 41 are transferred onto the sheet of paper P that has been transported by the transport unit 16. The belt cleaner 49 removes toner that remains on the surface of the intermediate transfer belt 41 instead of being transferred. The transfer unit 14 or the transport unit 16 transports the sheet of paper P onto which the images have been transferred to the heating unit 15. The developing units 13 and the transfer unit 14 are examples of an image forming unit according to an exemplary embodiment of the present invention that forms an image on a medium.

Figure 2:
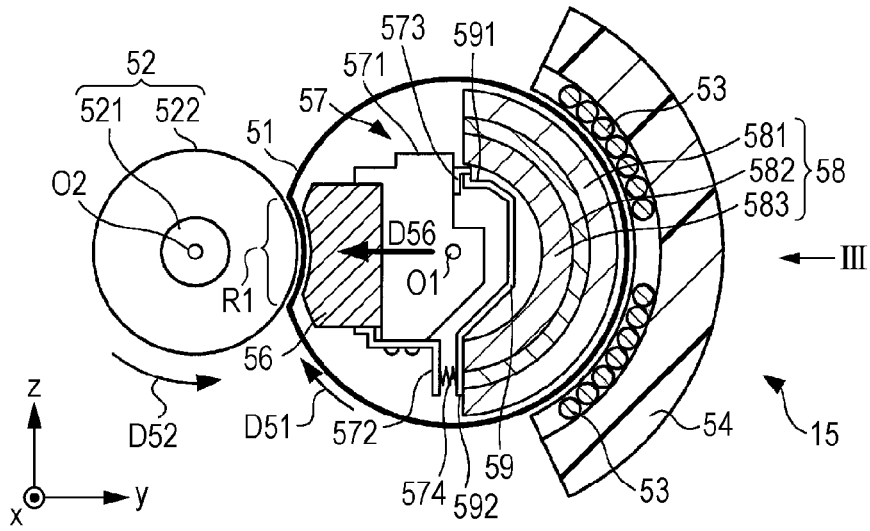
FIG. 2 illustrates the schematic structure of a heating unit.

The heating unit 15 is a heating device that fixes the images that have been transferred onto the sheet of paper P by heating the sheet of paper P. FIG. 2 illustrates the schematic structure of the heating unit 15. To explain the arrangement of elements of the heating unit 15, the space in which the elements are arranged is represented by using a right-handed coordinate system. Of the symbols of the coordinate system illustrated in FIG. 2, the white circle with a black dot at the center represents an arrow in the direction from the far side to the near side in the plane of FIG. 2. In this space, the direction along the x-axis is referred to as an x-axis direction. In the x-axis direction, the direction in which the x component increases is referred to as a +x direction and the direction in which the x component decreases is referred to as −x direction. Similarly, a y-axis direction, a +y direction, −y direction, a z-axis direction, a +z direction, and −z direction are defined for the y and z components. FIG. 2 is a sectional view of the heating unit 15 taken along line II-II in FIG. 3. When the sheet of paper P passes through the heating unit 15, the sheet of paper P is transported in the z-axis direction while the surface thereof on which an image is formed is oriented in the +y direction. Thus, the z-axis direction is the transporting direction of the sheet of paper P, and the x-axis direction is the width direction of the sheet of paper P.

The heating unit 15 includes a heating belt 51, a pressing roller 52, an electromagnetic induction portion 53, magnetic cores 54, a pressing pad 56, a holder 57, a heat transfer unit 58, and a shielding member 59. Referring to FIG. 2, the heating belt 51 rotates in the direction of arrow D51 around an axis O1 that is parallel to the x-axis direction. As illustrated in FIG. 2, the pressing roller 52 includes a cylindrical core 521 made of metal and an elastic layer 522 formed on the surface of the core 521. The core 521 rotates in the direction of arrow D52 around an axis O2 that is parallel to the axis O1 and located downstream of the axis O1 in the −y direction. Accordingly, the elastic layer 522 also rotates in the direction of arrow D52. The elastic layer 522 is made of, for example, a silicone rubber layer or a fluorocarbon rubber layer. The elastic layer 522 may have a surface releasing layer (fluorocarbon resin layer) on the surface thereof.

The pressing roller 52 presses the sheet of paper P that has been transported by the transport unit 16 against the heating belt 51 while being rotated by a drive unit (not shown). Thus, the pressing roller 52 assists the operation of heating the sheet of paper P with the heating belt 51. The heating belt 51 receives a frictional force from the pressing roller 52, and is thereby rotated by the rotation of the pressing roller 52.

The pressing pad 56, the holder 57, and the heat transfer unit 58 are arranged inside the heating belt 51.

The holder 57 includes a frame 571, a support member 572, a fixing member 573, and an elastic member 574. The frame 571 extends in the x-axis direction, and both end portions (not shown) of the frame 571 in the x-axis direction are fixed to a housing of the image forming apparatus 1. The frame 571 may be formed of, for example, a heat-resistant resin, such as glass-filled polyphenylene sulfide (PPS), or a non-magnetic metal such as gold (Au), silver (Ag), aluminum (Al), or copper (Cu). In the case where the shielding member 59 is provided as in the present exemplary embodiment, the frame 571 may be formed of a ferrous material having a high rigidity. In such a case, the frame 571 does not easily affect an induced magnetic field, nor is it easily affected by the induced magnetic field. The frame 571 retains the pressing pad 56 such that the pressing pad 56 may be pressed in the direction of arrow D56 (−y direction) in FIG. 2, that is, in the direction toward the pressing roller 52.

The frame 571, which retains the pressing pad 56, is formed of a material having a high rigidity so that the amount of bending of the frame 571 is less than or equal to a predetermined amount when the pressing pad 56 receives a pressing force from the pressing roller 52. Accordingly, the pressure (nipping pressure) applied in the nipping region R1 is maintained uniform in the x-axis direction. The support member 572 and the fixing member 573 are both attached to the frame 571 with connecting parts, such as screws.

The shielding member 59 is disposed between the electromagnetic induction portion 53 and the frame 571 so that magnetic paths generated by the electromagnetic induction portion 53 do not easily leak toward the frame 571. As illustrated in FIG. 2, one end portion 591 of the shielding member 59 is fixed to the fixing member 573 attached to the frame 571. An upstream end portion of the heat transfer unit 58 in a rotation direction of the heating belt 51 is also fixed to the fixing member 573. The other end portion 592 of the shielding member 59 is connected to a downstream end portion of the heat transfer unit 58 in the rotation direction. The elastic member 574 is disposed between the end portion 592 of the shielding member 59 and the support member 572.

In this structure, the shielding member 59 is made of aluminum or the like and is elastic. Therefore, the end portion 592 of the shielding member 59 moves in the +y and −y directions with the end portion 591 serving as a supporting point. The elastic member 574 exerts a force in the rightward direction in FIG. 2, that is, in the +y direction. Owing to this force, the end portion 592 of the shielding member 59 is pushed in the +y direction.

The pressing pad 56 is formed of, for example, a heat-resistant resin such as liquid crystal polymer (LCP), and is retained by the frame 571 of the holder 57 at a position where the pressing pad 56 faces the pressing roller 52. The pressing pad 56 is arranged such that the pressing pad 56 is pressed by the pressing roller 52 with the heating belt 51 interposed therebetween, and presses the heating belt 51 toward the pressing roller 52 (in the −y direction) from the inside of the heating belt 51. Thus, the nipping region R1 is formed between the heating belt 51 and the pressing roller 52. The sheet of paper P is transported so as to pass through the nipping region R1. In the nipping region R1, the pressing pad 56 is deformed by the pressing roller 52 so as to be recessed toward the axis O1, and the heating belt 51 extends along the shape of the pressing pad 56 that is deformed in this manner. The pressing pad 56 may be made of an elastic material such as silicone rubber layer or fluorocarbon rubber.

The heat transfer unit 58 includes a thermosensitive layer 581, a diffusion layer 582, and a heat storage layer 583 that are stacked in that order from the inner peripheral surface side of the heating belt 51 toward the axis O1. The heat transfer unit 58 is urged radially around the axis O1 by a support mechanism including the holder 57 and the shielding member 59, so that the state in which the heat transfer unit 58 is in contact with the inner peripheral surface of the heating belt 51 is maintained.

The thermosensitive layer 581 contains a metal material having a Curie point, and is made of, for example, a Ni—Fe based or Ni—Cr—Fe based magnetic shunt alloy. The Curie point may be higher than or equal to the setting temperature of the heating belt 51 and lower than or equal to the allowable temperature of the heating belt 51. More specifically, the Curie point is preferably in the range of 170° C. or more and 250° C. and less, and more preferably, in the range of 190° C. or more and 230° C. or less.

The thermosensitive layer 581 is shaped so as to extend along the inner peripheral surface of the heating belt 51, and is in contact with the inner peripheral surface of the heating belt 51. The thermosensitive layer 581 faces the electromagnetic induction portion 53 with the heating belt 51 interposed therebetween. The thermosensitive layer 581 is prevented from contacting the holder 57 by the shielding member 59, and is in contact with the inner peripheral surface of the heating belt 51 while maintaining the cylindrical shape of the heating belt 51. The thermosensitive layer 581 transfers heat to the heating belt 51 by contacting and sliding along the inner peripheral surface of the heating belt 51. The thermosensitive layer 581 generates heat through electromagnetic induction caused by an alternating-current magnetic field generated by the electromagnetic induction portion 53.

The thickness of the thermosensitive layer 581 is, for example, 0.05 mm or more and 1.0 mm or less, and more preferably, 0.3 mm or more and 0.6 mm or less. The thermosensitive layer 581 may be shaped such that a part of a cylindrical member made of alloy having the above-described thickness is cut out, the part having a predetermined central angle (for example, 30° or more and 180° or less). However, the shape of the thermosensitive layer 581 is not particularly limited.

The heat storage layer 583 is made of a non-magnetic material such as aluminum (Al), and is fixed to the holder 57 with a support member (not shown). The heat storage layer 583 has a greater heat capacity than those of the heating belt 51 and the diffusion layer 582. The heat storage layer 583 stores heat generated by the heating belt 51 and the thermosensitive layer 581.

The diffusion layer 582 includes a material having carbon as a principal component, graphite, or carbon fiber. The diffusion layer 582 is interposed between the thermosensitive layer 581 and the heat storage layer 583. The term "principal component" means a component whose percentage content is 50 wt % or more. Since the diffusion layer 582 includes graphite or the like, the diffusion layer 582 has a higher thermal conductivity than those of the thermosensitive layer 581 and the heat storage layer 583 and conducts heat radially around the axis O1 so as to allow thermal conduction between the thermosensitive layer 581 and the heat storage layer 583. The diffusion layer 582 diffuses heat also in the direction along the axis O1 (axial direction) to reduce the temperature variation along the axial direction in the thermosensitive layer 581 and the heat storage layer 583.

Since the heat transfer unit 58 is connected to the end portion 592 of the shielding member 59, the force generated by the elastic member 574 serves as a force that presses the heat transfer unit 58 against the heating belt 51. As a result, the thermosensitive layer 581 is pressed against the heating belt 51. Even when, for example, the pressing roller 52 is configured such that the pressing roller 52 is repeatedly brought into contact with and separated from the heating belt 51 by a drive unit (moving mechanism), the state in which the thermosensitive layer 581 is pressed against the heating belt 51 is maintained. Therefore, the shape of the heating belt 51 is not largely changed and the substantially circular shape of the heating belt 51 is maintained. In other words, the elastic member 574 suppresses deformation of the heating belt 51. As a result, the state in which the heating belt 51 and the thermosensitive layer 581 are in contact with each other does not easily change, and the risk that the inner surface of the heating belt 51 will be damaged by an end portion of the thermosensitive layer 581 is reduced.

In addition, the diffusion layer 582 and the heat storage layer 583 are moved together with the thermosensitive layer 581 in the direction in which they are pressed by the elastic member 574. Therefore, the state in which the thermosensitive layer 581, the diffusion layer 582, and the heat storage layer 583 are in contact with each other also does not easily change. As a result, the state of formation of the magnetic paths does not easily change, and accordingly the thermal diffusion effect provided by the heat storage layer 583 does not easily change. Thus, irrespective of whether the pressing roller 52 is separated from the heating belt 51 or is in contact with the heating belt 51, the state in which the heating belt 51, the thermosensitive layer 581, the diffusion layer 582, and the heat storage layer 583 are in contact with each other is maintained. As a result, when the pressing roller 52 returns to the contact position to perform the fixing operation, the state in which the heat generated by the thermosensitive layer 581 is supplied to the heating belt 51 does not easily change. Accordingly, the fixing operation may be quickly started.

Since the state in which the heating belt 51, the thermosensitive layer 581, the diffusion layer 582, and the heat storage layer 583 are in contact with each other is maintained, the heat is not easily diffused to the outside. Therefore, even when the fixing operation is not performed, the temperature of the heating belt 51, the thermosensitive layer 581, the diffusion layer 582, and the heat storage layer 583 does not easily change. This also allows the fixing operation to be quickly started. Accordingly, the power consumption may be reduced.

The elastic member 574 is not particularly limited, and may be, for example, a leaf spring or a coil spring. From the viewpoint of easy assembly and design freedom, a coil spring may be used. The attachment position of the elastic member 574 is not particularly limited as long as the thermosensitive layer 581 and the heat storage layer 583 may be pressed against the heating belt 51. When the pressing roller 52 is separated from the heating belt 51, deformation of the heating belt 51 easily occurs at a downstream side of the heating belt 51 in the rotation direction thereof. To prevent the heating belt 51 from being damaged by the downstream end portion of the above-described thermosensitive layer 581, the elastic member 574 may be disposed at the end portion of the thermosensitive layer 581 or at a position near the end portion on the downstream thereof in the rotation direction of the heating belt 51.

Although the end portion 591 of the shielding member 59 is fixed in the above-described example, the end portion 591 is not necessarily fixed securely by adhesion, welding, screw fastening, etc., in the present exemplary embodiment. The end portion 591 may instead be loosely fixed by, for example, fitting. In such a case, the assembly may be facilitated.

The electromagnetic induction portion 53 includes an exciting coil to which an alternating current having a predetermined frequency is supplied from an exciting circuit (not shown) in response to an instruction from the controller 11. This frequency is, for example, a frequency of an alternating current generated by a general-purpose power supply, and is in the range of, for example, 20 kHz or more and 100 kHz or less. The amount of the alternating current is controlled by the controller 11. The exciting coil is formed by winding a Litz wire, which is a bundle of copper wires that are insulated from each other, in the shape of an oval or rectangular closed loop with a hollow space at the center. When the above-described alternating current from the exciting circuit is supplied to the exciting coil, an alternating-current magnetic field centered on the Litz wire is generated around the electromagnetic induction portion 53. The intensity of the alternating-current magnetic field increases as the amount of the current increases. The electromagnetic induction portion 53 is an example of a magnetic-field generating unit according to an exemplary embodiment of the present invention.

The magnetic cores 54 are arc-shaped ferromagnetic bodies made of, for example, a fired ferrite, a ferrite resin, or Permalloy. These materials are oxides or alloys having a relatively high magnetic permeability. Magnetic lines of force (magnetic flux) of the alternating-current magnetic field generated around the exciting coil of the electromagnetic induction portion 53 are guided into the magnetic cores 54. The magnetic cores 54 form paths of magnetic lines of force (magnetic paths) that extend from the magnetic cores 54, pass through the heating belt 51, and return to the magnetic cores 54. Since the magnetic cores 54 generate the magnetic paths, the magnetic lines of force of the above-described alternating-current magnetic field are concentrated at a portion of the heating belt 51 that faces the magnetic cores 54. A shield (not shown) is provided at the outer side of the magnetic cores 54 when viewed from the axis O1. The shield covers the alternating-current magnetic field so as to suppress leakage of the alternating-current magnetic field to the outside.

Figure 3:
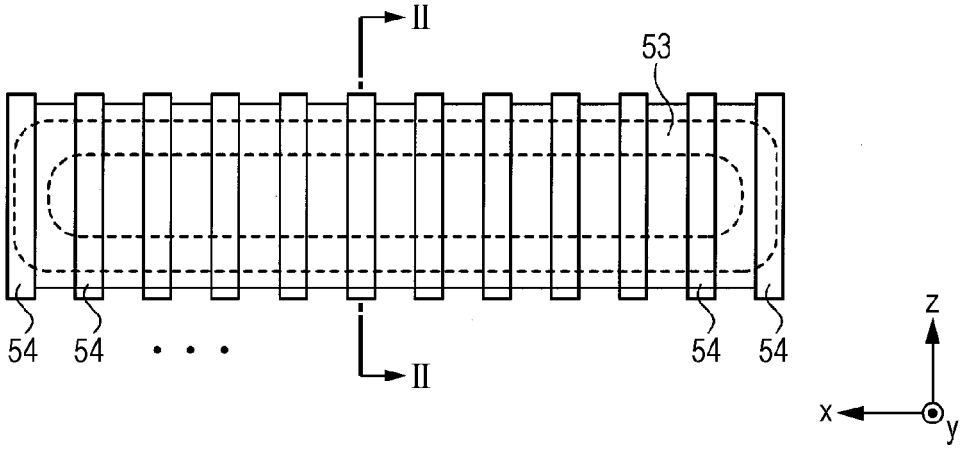
FIG. 3 illustrates the heating unit viewed in a direction of arrow III in FIG. 2.

FIG. 3 illustrates the heating unit 15 viewed in the direction of arrow III in FIG. 2. As illustrated in FIG. 3, the magnetic cores 54 included in the heating unit 15 are arranged in the x-axis direction with intervals therebetween. The magnetic cores 54 are not in contact with each other. The magnetic cores 54 are arranged in this manner to disperse, in the x-axis direction, the magnetic flux that passes through the magnetic cores 54. If, for example, a magnetic core made of a single plate that is continuous in the x-axis direction is used instead of the magnetic cores 54, the magnetic flux that extends through the magnetic core will be concentrated at the center thereof. In such a case, the density of the magnetic flux that passes through the heating belt 51 will be increased locally at the center in the x-axis direction. To prevent this, multiple magnetic cores 54 are used and are arranged in the x-axis direction with intervals therebetween so as not to be in contact with each other. Here, the state in which the magnetic flux "extends through" a member, such as a belt, having a layer structure means that the magnetic flux extends through the member having a layer structure in the thickness direction thereof.

The heating belt 51 is formed of an endless belt member whose original shape is cylindrical. When an alternating current is supplied to the exciting coil of the electromagnetic induction portion 53, an alternating-current magnetic field is generated around the electromagnetic induction portion 53. The alternating-current magnetic field acts on the members included in the heating belt 51, so that the sheet of paper P that is in contact with the outer peripheral surface of the heating belt 51 is heated. Thus, the electromagnetic induction portion 53 heats the medium through the heating belt 51 with an amount of heat that corresponds to the electric power supplied to the electromagnetic induction portion 53. As a result, the image that has been transferred onto the medium is fixed to the medium.

Figure 4:
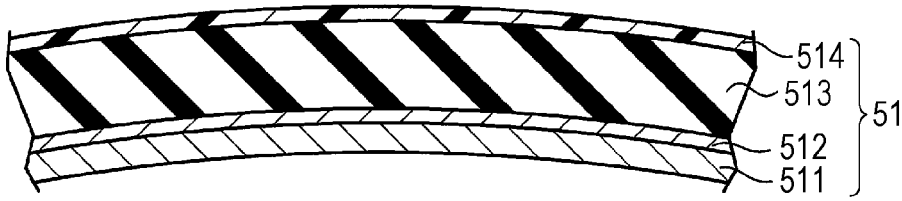
FIG. 4 is an enlarged view of a part of a heating belt.

FIG. 4 is an enlarged view of a part of the heating belt 51. The heating belt 51 includes a base layer 511, a conductive heat-generating layer 512, an elastic layer 513, and a surface releasing layer 514. The base layer 511, which is formed of a heat-resistant sheet-shaped member, supports the conductive heat-generating layer 512 and provides the overall mechanical strength of the heating belt 51. The material and thickness of the base layer 511 are determined so that the base layer 511 has physical properties (relative permeability and specific resistance) that allow the alternating-current magnetic field to extend through the base layer 511. The base layer 511 does not generate heat or generates a smaller amount of heat than the amount of heat generated by the conductive heat-generating layer 512 when the alternating-current magnetic field is applied. The base layer 511 is made of a non-magnetic metal such as a non-magnetic stainless steel, a soft magnetic material (e.g., Permalloy or Sendust (registered trademark)), or a hard magnetic material (Fe—Ni—Co or Fe—Cr—Co alloy), and has a thickness of 30 μm or more and 200 μm or less (preferably 50 μm or more and 150 μm, more preferably, 100 μm or more and 150 μm or less). Alternatively, the base layer 511 is made of a resin material, such as a polyimide belt, having a thickness of 50 μm or more and 200 μm or less.

The conductive heat-generating layer 512 is formed of a non-magnetic metal such as gold (Au), silver (Ag), aluminum (Al), or copper (Cu) or an alloy thereof, and has a thickness of 2 μm or more and 20 μm or less (preferably 5 μm or more 10 μm or less). These materials are paramagnetic materials having a relative permeability of around 1 and a specific resistance of $2.7\times10^{-8}$ Ω·m or less. When the alternating-current magnetic field generated by the electromagnetic induction portion 53 extends through the conductive heat-generating layer 512 in the thickness direction thereof, electromagnetic induction occurs and an eddy current flows through the conductive heat-generating layer 512. The conductive heat-generating layer 512 generates heat when the eddy current flows therethrough. In this manner, the conductive heat-generating layer 512 is heated by the alternating-current magnetic field generated by the electromagnetic induction portion 53. In the following description, the phenomenon that the heating belt 51 including the conductive heat-generating layer 512 generates heat, in other words, is heated, by the electromagnetic induction caused by the alternating-current magnetic field is referred to as "electromagnetic induction heating".

The elastic layer 513 is formed of a material, such as silicone rubber, fluorocarbon rubber, or fluorosilicone rubber, that deforms when a pressure is applied thereto and that returns to its original shape when the pressure is removed. For example, the elastic layer 513 is formed of a silicone rubber material having a JIS-A hardness of 10° or more and 30° or less, and has a thickness of 100 μm or more and 600 μm or less. The image that has been transferred onto the sheet of paper P by the second transfer roller 42 is formed by stacking layers of toners, which are powders, of different colors. Therefore, the image has small protrusions and recesses. The elastic layer 513 is deformed in accordance with the protrusions and recesses in the image. If the elastic layer 513 is not deformable as described above, the amount of heat supplied to the image differs between portions that contact the heating belt 51 and portions that do not contact the heating belt 51. As a result, the image will be fixed nonuniformly. The nonuniformity may be reduced by causing the elastic layer 513 to be deformed as described above.

The surface releasing layer 514 comes into direct contact with the image (toners) on the sheet of paper. Therefore, it is desirable that the surface releasing layer 514 have a high releasability from the toners. The surface releasing layer 514 is formed of a material having a relatively high releasability from the toners. For example, the surface releasing layer 514 may be formed of a tetrafluoroetylene-perfluoroalkylvinylether copolymer (PFA), polytetrafluoroethylene (PTFE), a silicone copolymer, or a composite lamination thereof. As the thickness of the surface releasing layer 514 decreases, the time decreases in which the layer thickness is reduced by abrasion and the surface releasing layer 514 becomes unable to function as a releasing layer. In other words, the life of the heating belt 51 decreases. As the thickness of the surface releasing layer 514 increases, the harness of the surface layer of the heating belt 51 increases and the effect of the elastic layer 513 decreases. As a result, the image will be fixed nonuniformly as described above. To set the life and the uniformity of the fixed image in predetermined ranges, the thickness of the surface releasing layer 514 is set in the range of 1 μm or more and 50 μm or less.

1-2. Operation

Figure 5:
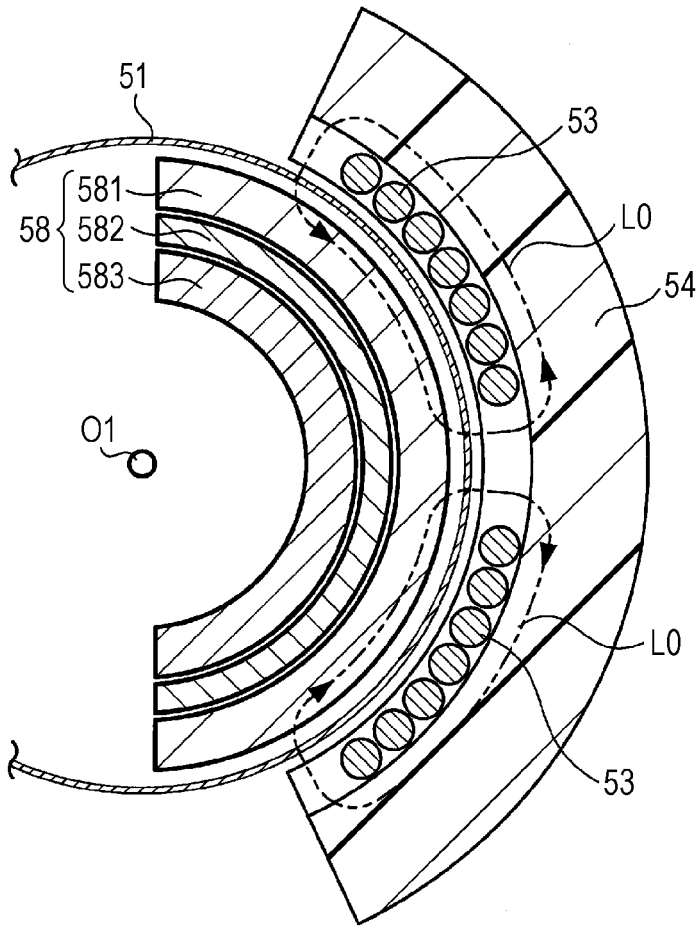
FIG. 5 illustrates the operation of a thermosensitive layer at a temperature below the Curie point.

FIG. 5 illustrates the operation of the thermosensitive layer 581 at a temperature below (lower than) the Curie point. When the temperature is below the Curie point, the thermosensitive layer 581 functions as a ferromagnetic body. Therefore, the alternating-current magnetic field that has been generated by the electromagnetic induction portion 53 and that extends through the heating belt 51 passes through the thermosensitive layer 581 along the shape of the thermosensitive layer 581. In other words, the magnetic flux of the alternating-current magnetic field forms magnetic paths that extend in the direction in which the thermosensitive layer 581 extends. Thus, as illustrated in FIG. 5, magnetic paths L0 are generated which surround portions of the electromagnetic induction portion 53 and the heating belt 51 and which extend along the magnetic cores 54 and the thermosensitive layer 581. Since the magnetic paths L0 that extend along the shape of the thermosensitive layer 581 are generated, the density of the magnetic flux that extends through the heating belt 51 is relatively high. Accordingly, the amount of heat generated by the heating belt 51 is increased. In addition, the alternating-current magnetic field does not easily leak from the thermosensitive layer 581, so that a relatively large amount of heat is generated by the thermosensitive layer 581.

Figure 6:
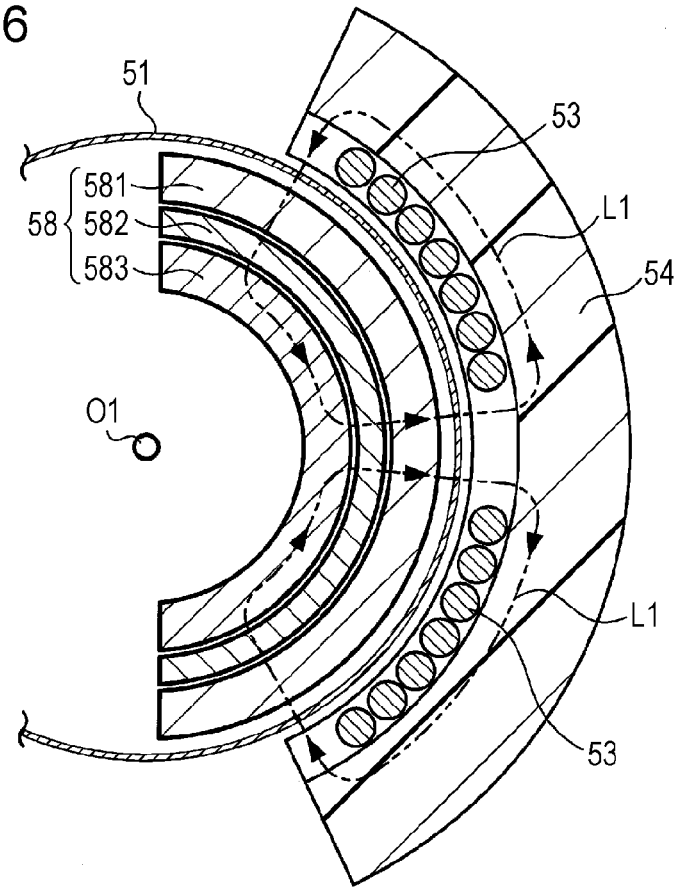
FIG. 6 illustrates the operation of the thermosensitive layer at a temperature higher than or equal to the Curie point.

FIG. 6 illustrates the operation of the thermosensitive layer 581 at a temperature higher than or equal to the Curie point. When the temperature is higher than or equal to the Curie point, the thermosensitive layer 581 functions as a non-magnetic body. Therefore, the alternating-current magnetic field that has been generated by the electromagnetic induction portion 53 and that extends through the heating belt 51 extends through the thermosensitive layer 581 and reaches the diffusion layer 582 and the heat storage layer 583. In other words, the magnetic flux of the alternating-current magnetic field forms magnetic paths that extend through the thermosensitive layer 581 and reach the heat storage layer 583. The heat storage layer 583 is a non-magnetic body and has a thickness such that the heat storage layer 583 does not allow the above-described alternating-current magnetic field to extend therethrough. As illustrated in FIG. 6, magnetic paths L1 are generated which surround portions of the electromagnetic induction portion 53, the heating belt 51, the thermosensitive layer 581, and the diffusion layer 582 and which extend along the heat storage layer 583. The current that flows through the heat storage layer 583 serves to cancel the magnetic flux that passes through the thermosensitive layer 581, thereby reducing the density of the magnetic flux that extends through the heating belt 51. As a result, the rate of heating of the heating belt 51 when the temperature is higher than or equal to the Curie point is lower than that when the temperature is below the Curie point.

The thermosensitive layer 581 is positioned closer to the heating belt 51 than the heat storage layer 583. The thermosensitive layer 581 allows the alternating-current magnetic field to enter from the heating belt 51 when the temperature is below the Curie temperature, and allows the magnetic flux of the alternating-current magnetic field to extend therethrough when the temperature is higher than or equal to the Curie temperature.

Figure 7:
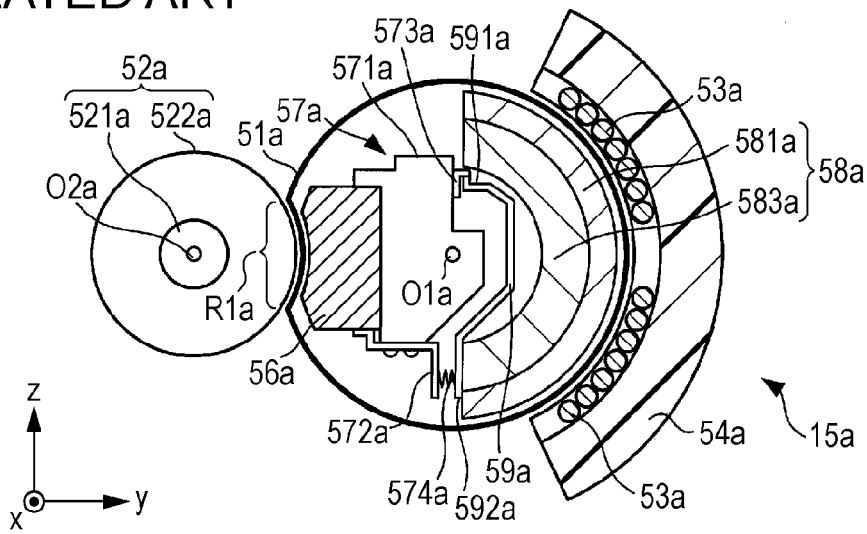
FIG. 7 RELATED ART
FIG. 7 illustrates the schematic structure of a heating unit that has no diffusion layer.

The temperature distribution in the heating belt 51 in the above-described structure will now be described. A heating unit 15*a* will be described as a comparative example to be compared with the heating unit 15. FIG. 7 illustrates the schematic structure of the heating unit 15*a*, which is a heating unit that does not have the diffusion layer 582. The heating unit 15*a* differs from the heating unit 15 in that the diffusion layer 582 is not provided and the heating unit 15*a* includes a thermosensitive layer 581*a* and a heat storage layer 583*a* that are in contact with each other. The structures of other components of the heating unit 15*a* are similar to those of the components of the heating unit 15 denoted by reference numerals without the letter 'a' appended at the end.

Figure 8:
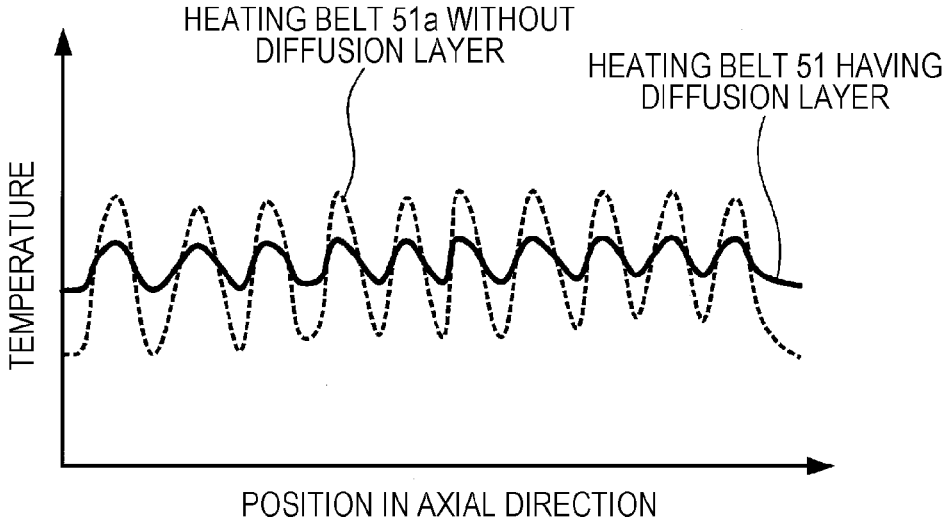
FIG. 8 illustrates the temperature distributions in heating belts of the heating units.

FIG. 8 is a graph of temperature distributions that are generated in the heating belt 51 of the heating unit 15 and the heating belt 51*a* of the heating unit 15*a*. As illustrated in FIG. 3, the magnetic cores 54 (magnetic cores 54*a*) are arranged in the x-axis direction (width direction of the sheet of paper P) with intervals therebetween. Therefore, the density of the magnetic flux that extends through the heating belt 51 (heating belt 51*a*) is high at positions where the heating belt 51 (heating belt 51*a*) faces the magnetic cores 54 (magnetic cores 54*a*) and low at positions between the magnetic cores 54 (magnetic cores 54*a*). As a result, heat is intensively generated in areas of the heating belt 51 (heating belt 51*a*) in which the density of the magnetic flux is high, and temperature distribution that is nonuniform along the axial direction is generated. The heating belt 51 having the nonuniform temperature distribution along the axial direction heats the image nonuniformly in accordance with the nonuniform temperature distribution. The nonuniform heating may cause nonuniform glossiness in the fixed image.

The heat transfer unit 58, which includes the diffusion layer 582, diffuses more heat in the width direction compared to the heat transfer unit 58*a*, which does not include the diffusion layer 582, the heat having been supplied from the heating belt 51. Accordingly, as illustrated in FIG. 8, the temperature variation in the heating belt 51 along the width direction is smaller than that in the heating belt 51*a*. Thus, the influence of the temperature variation on the image forming operation may be suppressed when the diffusion layer 582 is included in the heat transfer unit 58 of the heating unit 15.

2. Second Exemplary Embodiment 2-1. Structure

Figure 9:
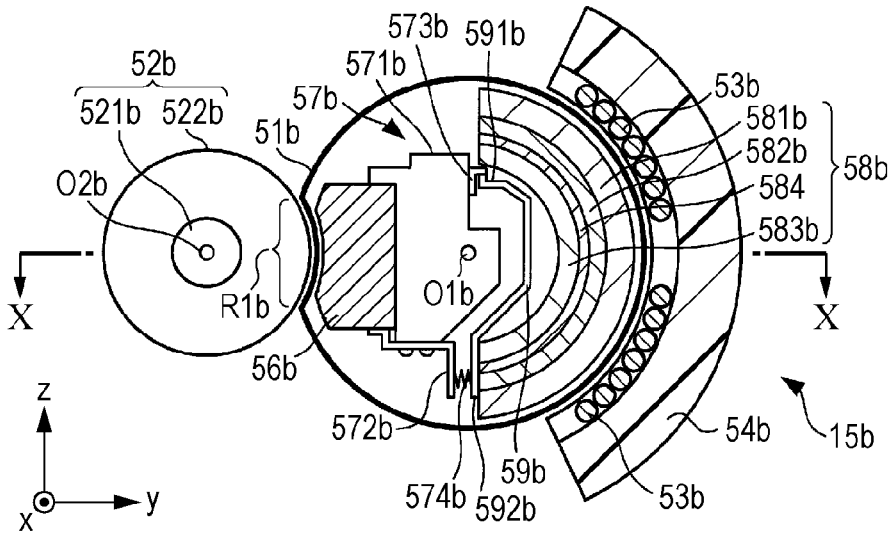
FIG. 9 illustrates the schematic structure of a heating unit according to a second exemplary embodiment.

An image forming apparatus (not shown) according to a second exemplary embodiment of the present invention will be described. The image forming apparatus according to the second exemplary embodiment differs from the image forming apparatus 1 according to the first exemplary embodiment in that a heating unit 15*b* is used instead of the heating unit 15. Other structures are similar to those of the first exemplary embodiment. The heating unit 15*b* according to the second exemplary embodiment differs from the heating unit 15 according to the first exemplary embodiment in that the heating unit 15*b* includes a heat transfer unit 58*b* including a heating layer 584. FIG. 9 illustrates the schematic structure of the heating unit 15*b* according to the second exemplary embodiment. The structures of components of the heating unit 15*b* other than the heating layer 584 are similar to those of the components of the heating unit 15 denoted by reference numerals without the letter 'b' appended at the end. As illustrated in FIG. 9, the heating layer 584 is interposed between a diffusion layer 582*b* and a heat storage layer 583*b* in the heat transfer unit 58*b*. The heating layer 584 is a resistor that generates Joule heat when electricity is applied thereto. The generated Joule heat is transmitted to the outer peripheral side of a heating belt 51*b* through the diffusion layer 582*b*, a thermosensitive layer 581*b*, and the heating belt 51*b*, so that the sheet of paper P is heated.

Figure 10:
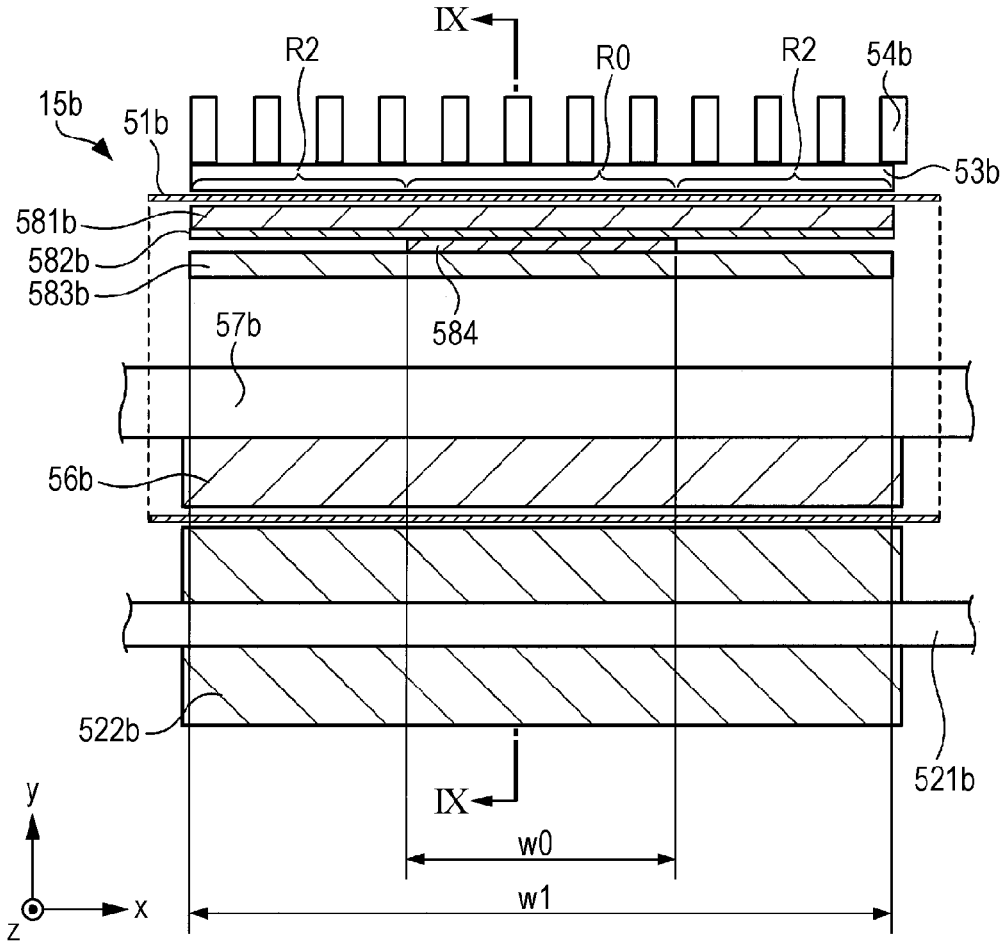
FIG. 10 is a sectional view of the heating unit taken along line X-X in FIG. 9.

FIG. 10 is a sectional view of the heating unit 15*b* taken along line X-X in FIG. 9. FIG. 9 is a sectional view of the heating unit 15*b* taken along line IX-IX in FIG. 10. The heating layer 584 has a length (width) in the axial direction that is smaller than that of the electromagnetic induction portion 53*b*, the thermosensitive layer 581*b*, the diffusion layer 582*b*, and the heat storage layer 583*b* so that, of the sheets of paper P that may be used in the image forming apparatus, the sheets of paper P having a small width may be effectively heated. More specifically, as illustrated in FIG. 10, the width of the heating layer 584 is w0. The width of the electromagnetic induction portion 53*b*, the thermosensitive layer 581*b*, the diffusion layer 582*b*, and the heat storage layer 583*b* is w1, which is greater than w0. The range of the heating layer 584 is within the range of the electromagnetic induction portion 53*b* in the axial direction. The region of the heating belt 51*b* in which the heating belt 51*b* faces the electromagnetic induction portion 53*b* is hereinafter referred to as a first region. The region of the heating belt 51*b* in which the heating belt 51*b* faces the heating layer 584 is hereinafter referred to as a second region. The first region is a region in which heat is generated by the electromagnetic induction caused by the electromagnetic induction portion 53*b*. The second region is included in the first region and has a width w0 (second width) that is smaller than the width w1 (first width) of the first region.

The region R0 illustrated in FIG. 10 is the second region in which the heating belt 51*b* faces the heating layer 584. The width of the sheets of maximum-width paper P1 is w1, and the width of the sheets of small-width paper P2 is w0. When an image formed on a sheet of small-width paper P2 is fixed, the region R0 illustrated in FIG. 10 serves as a region in which the sheet of small-width paper P2 passes through the nipping region R1*b* (hereinafter referred to as a paper passing region). Regions R2 on both sides of the region R0 are regions other than the paper passing region (hereafter referred to as paper non-passing regions). Since the width of the electromagnetic induction portion 53*b* is w1, when the heating belt 51*b* is heated by the electromagnetic induction portion 53*b*, both the region R0 and the regions R2 are heated. In other words, the entire area of the first region is heated. In this case, the sheet of small-width paper P2 does not absorb the heat in the paper non-passing regions, and therefore the heat in the regions R2 accumulates in the heating belt 51*b*. The heating layer 584 heats the region R0 (that is, the second region) of the heating belt 51*b*, and does not heat the regions R2 (that is, the areas of the first region excluding the second region). Therefore, when the electromagnetic induction heating using the electromagnetic induction portion 53*b* and the thermal conduction heating using a resistive heating element included in the heating layer 584 are performed in combination, the heat accumulated in the paper non-passing regions is reduced compared to that in the case where only the electromagnetic induction heating is performed.

Figure 11:
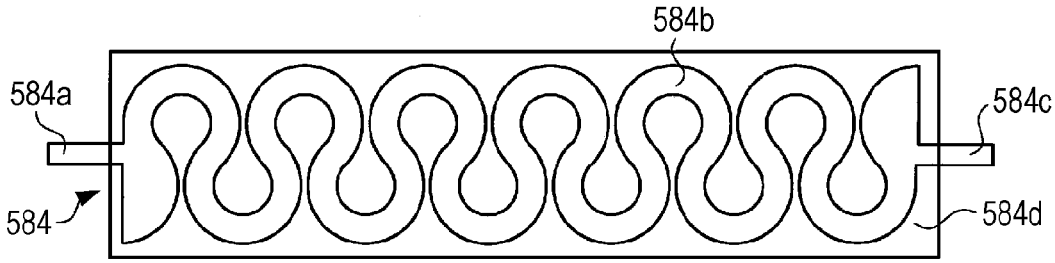
FIG. 11 illustrates an example of the appearance of a heating layer.

FIG. 11 illustrates an example of the appearance of the heating layer 584. As illustrated in FIG. 11, the heating layer 584 includes two electrodes 584*a* and 584*c*, a resistance member 584*b* that extends between the electrodes 584*a* and 584*c* in a meandering manner, and two films 584*d* that sandwich the resistance member 584*b* from both sides thereof. For example, the resistance member 584*b* is formed of a stainless steel and has a thickness of 30 μm, and the two films 584*d* are formed of polyimide and have a thickness of 50 μm. The resistance member 584*b* generates heat when a voltage is applied between the two electrodes 584*a* and 584*c*.

2-2. Operation

Figure 12:
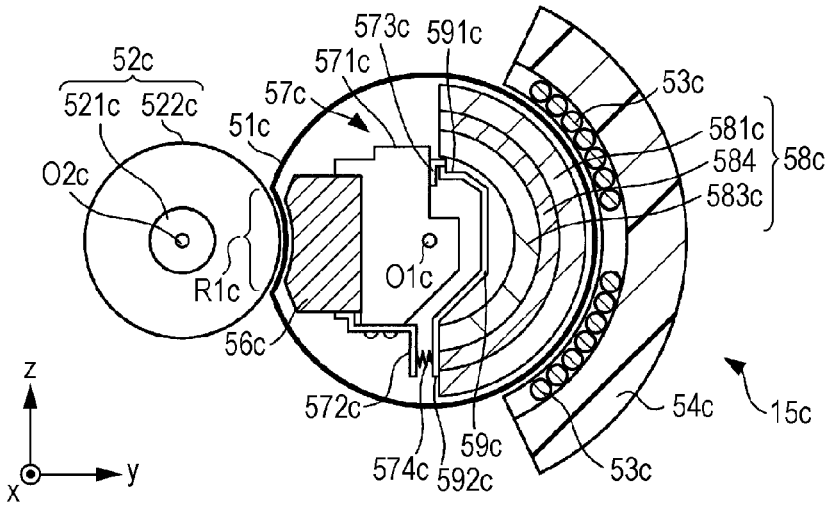
FIG. 12 RELATED ART
FIG. 12 illustrates the schematic structure of a heating unit that has no diffusion layer.

The temperature distribution generated in the heating belt 51*b* having the above-described structure will now be described. A heating unit 15*c* will be described as a comparative example to be compared with the heating unit 15*b*. FIG. 12 illustrates the schematic structure of the heating unit 15*c*, which is a heating unit that does not have the diffusion layer 582. The heating unit 15*c* differs from the heating unit 15*b* in that the diffusion layer 582*b* is not provided and the heating unit 15*c* includes a thermosensitive layer 581*c* and a heating layer 584 that are in contact with each other. The structures of other components of the heating unit 15*c* are similar to those of the components of the heating unit 15*b* denoted by reference numerals with the letter 'b' appended at the end instead of the letter 'c'. Here, the heating unit 15*a* illustrated in FIG. 7 is also used as a comparative example. The heating unit 15*a* differs from the heating unit 15*b* in that the diffusion layer 582*b* and the heating layer 584 are not provided and the thermosensitive layer 581*a* and the heat storage layer 583*a* are in contact with each other.

Figure 13:
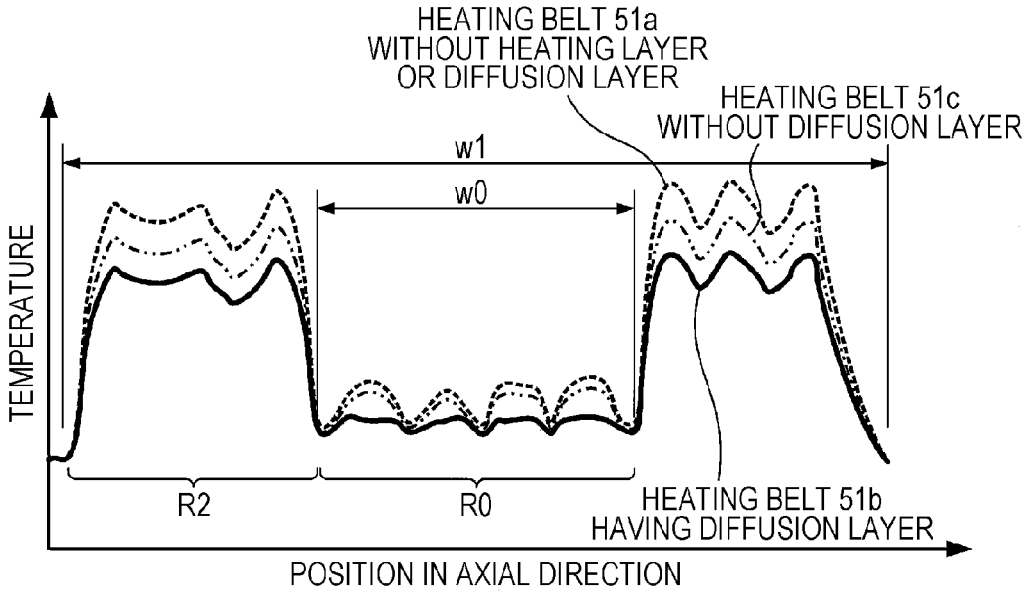
FIG. 13 illustrates the temperature distributions in heating belts of the heating units.

FIG. 13 is a graph of temperature distributions that are generated in the heating belt 51*a* of the heating unit 15*a*, the heating belt 51*b* of the heating unit 15*b*, and the heating belt 51*c* of the heating unit 15*c*. FIG. 13 shows the temperature distributions in the nipping region R1*b* (R1*a*, R1*c*) of the heating belt 51*b* (51*a*, 51*c*) after the sheet of small-width paper P2 having the width w0 has passed therethrough.

The heat transfer unit 58 of the heating unit 15*a* does not include the heating layer 584, and therefore the heating belt 51*a* is heated only by the alternating-current magnetic field generated by the electromagnetic induction portion 53*a*. Therefore, even when an image formed on a sheet of small-width paper P2 having the width w0 is fixed, both the region R0, which is the paper passing region, and the regions R2, which are the paper non-passing regions, are heated.

In contrast, each of the heating unit 15*b* and the heating unit 15*c* includes the heating layer 584, so that the heating belt 51*b* and the heating belt 51*c* perform heating by using the combination of the electromagnetic induction heating and the thermal conduction heating using the resistive heating element. Therefore, when an image formed on a sheet of small-width paper P2 having the width w0 is fixed, the ratio of heating of the heating belt 51*b* performed by the heating layer 584 may be increased. In such a case, the temperature increase in the regions R2, which are the paper non-passing regions, may be suppressed.

In addition, the heating unit 15*b* includes the diffusion layer 582*b*, which is not included in the heating unit 15*c*. The heating belt 51*b* and the thermosensitive layer 581*b* are in contact with each other to allow thermal conduction therebetween. The heat of the thermosensitive layer 581*b* is diffused along the diffusion layer 582*b* in various directions including the axial direction. Therefore, as illustrated in FIG. 13, the nonuniformity of the temperature distribution in the axial direction in the heating belt 51*b*, which includes the diffusion layer 582*b* that diffuses the heat, is smaller than that in the heating belt 51*c*.

3. Modification

Although the exemplary embodiments have been described, the exemplary embodiments may be modified as described hereinafter. The modifications described hereinafter may be applied in combination.

3-1. Heating Layer

According to the above-described exemplary embodiments, the heating layer 584 generates Joule heat when electricity is applied thereto, and the generated Joule heat is transmitted through the heating belt 51 to the sheet of paper P that is in contact with the outer peripheral surface of the heating belt 51. However, the heating layer that heats the sheet of paper P is not limited to this. For example, the heating layer may include a heat exchanger heater that circulates a liquid heating medium through a pipe disposed in the heating layer. The heating layer is not particularly limited as long as the heating layer heats the second region to fix an image formed on a medium that passes through the second region, the second region being included in the first region and having a second width that is smaller than a first width.

3-2. Diffusion Layer

According to the above-described exemplary embodiments, the diffusion layer 582 includes a material having carbon as a principal component, graphite, or carbon fiber. However, the diffusion layer 582 does not necessarily include these materials. The diffusion layer 582 is not particularly limited as long as the diffusion layer 582 has a higher thermal conductivity than those of the thermosensitive layer 581 and the heat storage layer 583 and disperses heat of the heating belt 51 in the axial direction thereof.

3-3. Thermosensitive Layer

The thermosensitive layer 581 may function as a heat storage layer that stores heat. In addition, the heat transfer unit 58 does not necessarily include the thermosensitive layer 581. In this case, the diffusion layer 582 may be arranged on either the outer peripheral surface or the inner peripheral surface of the heat storage layer 583. Of the diffusion layer 582, the heating layer 584, and the heat storage layer 583, the layer that is at the outermost position transmits heat to the heating belt 51 by contacting and sliding along the inner peripheral surface of the heating belt 51.

3-4. Protective Layer

A surface of the heat transfer unit 58 that contacts the heating belt 51 may be provided with a protective layer to protect the surface from abrasion or the like. The protective layer may include a material that ensures smooth sliding of the heating belt 51. The material may be, for example, PFA, PTFE, silicone copolymer, or a composite lamination thereof.

3-5. Medium

In the above-described second exemplary embodiment, two types of sheets of paper P are used as media, the two types of sheets of paper P including the sheets of small-width paper P2 with the width w0 and the sheets of maximum-width paper P1 with the width w1. However, the number of types sheets of paper that may be used in the image forming apparatus is not limited to two, and three or more types of sheets of paper may be used. In the case where three or more types of media may be used in the image forming apparatus, the image forming apparatus may include the same number of heating layers as the number of widths of the media. The heating layers may be configured such that each heating layer heats a region in which the media corresponding to the heating layer passes.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating device comprising:

a magnetic-field generating unit configured to generate an alternating-current magnetic field;

an endless belt comprising a first region in which heat is generated by electromagnetic induction caused by an effect of the alternating-current magnetic field, the endless belt configured to heat and transport a medium that contacts an outer peripheral surface of the endless belt; and a heat transfer unit configured to transmit heat to the belt by contacting and sliding along an inner peripheral surface of the belt, wherein the heat transfer unit comprises:

a heat storage layer configured to store heat, a thermosensitive layer positioned closer to the belt than the heat storage layer is and extending so as to separate the magnetic-field generating unit and the heat storage layer from each other, the thermosensitive layer configured to provide a magnetic path that allows a magnetic flux of the alternating-current magnetic field to pass through the thermosensitive layer in a direction in which the thermosensitive layer extends at a temperature below a Curie temperature and configured to provide a magnetic path that allows the magnetic flux of the alternating-current magnetic field to extend through the thermosensitive layer and reach the heat storage layer at a temperature higher than or equal to the Curie temperature, and a diffusion layer having a higher thermal conductivity than thermal conductivities of the thermosensitive layer and the heat storage layer, the diffusion layer configured to diffuse heat of the belt along an axial direction of the belt.

2. The heating device according to claim 1, wherein the heat storage layer has a greater heat capacity than a heat capacity of the diffusion layer.

3. The heating device according to claim 1, wherein the heat transfer unit further comprises a heating layer disposed between the thermosensitive layer and the heat storage layer so as to face a second region that is included in the first region and that has a smaller length than a length of the first region in the axial direction, the heat transfer unit heating the second region, and wherein the diffusion layer is in contact with the heating layer.

4. The heating device according to claim 3, wherein the heating layer is configured to heat the second region with Joule heat generated when electricity is applied to the heating layer.

5. The heating device according to claim 1, wherein the diffusion layer comprises a material having carbon as a principal component, graphite, or carbon fiber.

6. An image forming apparatus comprising:

an image forming unit that forms an image on a medium;

a transport unit that transports the medium on which the image has been formed by the image forming unit to a heating region; and the heating device according to claim 1, the heating device heating the medium that has been transported by the transport unit.

* * * * *